United States Patent [19]

Allard et al.

[11] 4,251,988

[45] Feb. 24, 1981

[54] DEFROSTING SYSTEM USING ACTUAL DEFROSTING TIME AS A CONTROLLING PARAMETER

[75] Inventors: John J. Allard, Mishicot; Robert A. Heinzen, Manitowoc, both of Wis.

[73] Assignee: AMF Incorporated, White Plains, N.Y.

[21] Appl. No.: 967,751

[22] Filed: Dec. 8, 1978

[51] Int. Cl.[3] ..... F25D 21/00; G05D 23/32

[52] U.S. Cl. ..... 62/80; 62/155; 62/234; 62/157

[58] Field of Search ..... 62/234, 155, 80, 158, 62/154; 364/900, 118, 569; 340/309.1; 307/141, 141.4; 235/92 T

[56] References Cited

U.S. PATENT DOCUMENTS

| | | | |
|---|---|---|---|
| 4,156,350 | 5/1979 | Elliott et al. | 62/80 |
| 4,173,871 | 11/1979 | Brooks | 62/80 |

*Primary Examiner*—William E. Wayner
*Assistant Examiner*—Harry Tanner
*Attorney, Agent, or Firm*—George W. Price; John H. Gallagher

[57] ABSTRACT

An automatic defrost system in which the actual defrost time of an evaporator coil, for example, is the controlling parameter for establishing a defrost cycle. The system automatically adjusts itself so that a predetermined amount of frost builds up in the frost accumulating period.

12 Claims, 2 Drawing Figures

DEFROSTING SYSTEM USING ACTUAL DEFROSTING TIME AS A CONTROLLING PARAMETER

When a certain amount of frost accumulates on the evaporator coil of a refrigeration system, or of a heat pump, the heat transfer characteristics of the coil are significantly altered and the efficiency of the system deteriorates abruptly and appreciably. The amount of frost accumulation on a coil that will cause the abrupt change in efficiency is known by the manufacturer of the refrigeration system. Accordingly, automatic defrosting systems ideally will not allow frost to accumulate beyond a known limit in order to achieve optimum efficiency. On the other hand, optimum efficiency cannot be realized if the evaporator coil is defrosted too frequently.

It is known that the time required for a constant wattage heat source to defrost an evaporator coil is a direct function of the amount of frost on the coil. Consequently, if the defrosting operation is initiated each time the frost buildup reaches the above-mentioned critical limit beyond which the efficiency of the system is abruptly affected, the time required to defrost the coil always will be the same. Accordingly, it is an object of this invention to provide an efficient defrosting system that automatically seeks to defrost a heat transfer unit such as an evaporator coil when the critical limit of frost has accumulated. The system achieves this object by monitoring the time required to actually defrost the coil and adjusting the time periods between defrosting operations until no more than the critical amount of frost builds up on the coil before the next defrosting operation is initiated.

In accordance with this invention the actual defrost time of the evaporator coil is monitored for each defrost operation. If the actual defrost time is shorter than a predetermined optimal time it means that not enough frost was allowed to accumulate. Accordingly, the system automatically responds to lengthen the time between successive defrost periods so that more frost will accumulate. On the other hand, if the actual defrost time is longer than the predetermined optimal time it means that too much frost was allowed to accumulate. The system automatically responds to this condition to shorten the time period between successive defrost operations. In all cases, the actual defrost time is the controlling parameter that causes corrective adjustment in a defrosting cycle to achieve an optimum defrosting cycle. A defrosting cycle is defined to include one defrost operation and the next occurring frost accumulating period.

The system operates according to the following relationship.

$Ia = T_{(a-1)} + K(Dd - Da)$, wherein

Ta = Length of the next frost accumulating period.

$T_{(a-1)}$ = Length of the last frost accumulating period.

Dd = Desired (optimal) defrost time period.

Da = Length of the actual defrost period.

K = System constant that determines the multiple by which the frost accumulating period will change for each minute of error in the defrost time.

The invention will be described by referring to the accompanying drawings wherein.

The principles of this invention are applicable to a number of different types of temperature conditioning, or temperature controlling, systems. As an example, it may be employed in various ones of the presently common refrigeration systems, and it may be used in a heat pump system that both heats and cools. Whatever type of temperature conditioning system contemplated, the present invention defrosts the heat transfer unit, i.e., the evaporator coil, to allow the system to operate with optimum efficiency. The details of the temperature conditioning system, such as a refrigeration system or heat pump system, are not the subject of the present invention and will not be discussed in detail.

Figure 1:
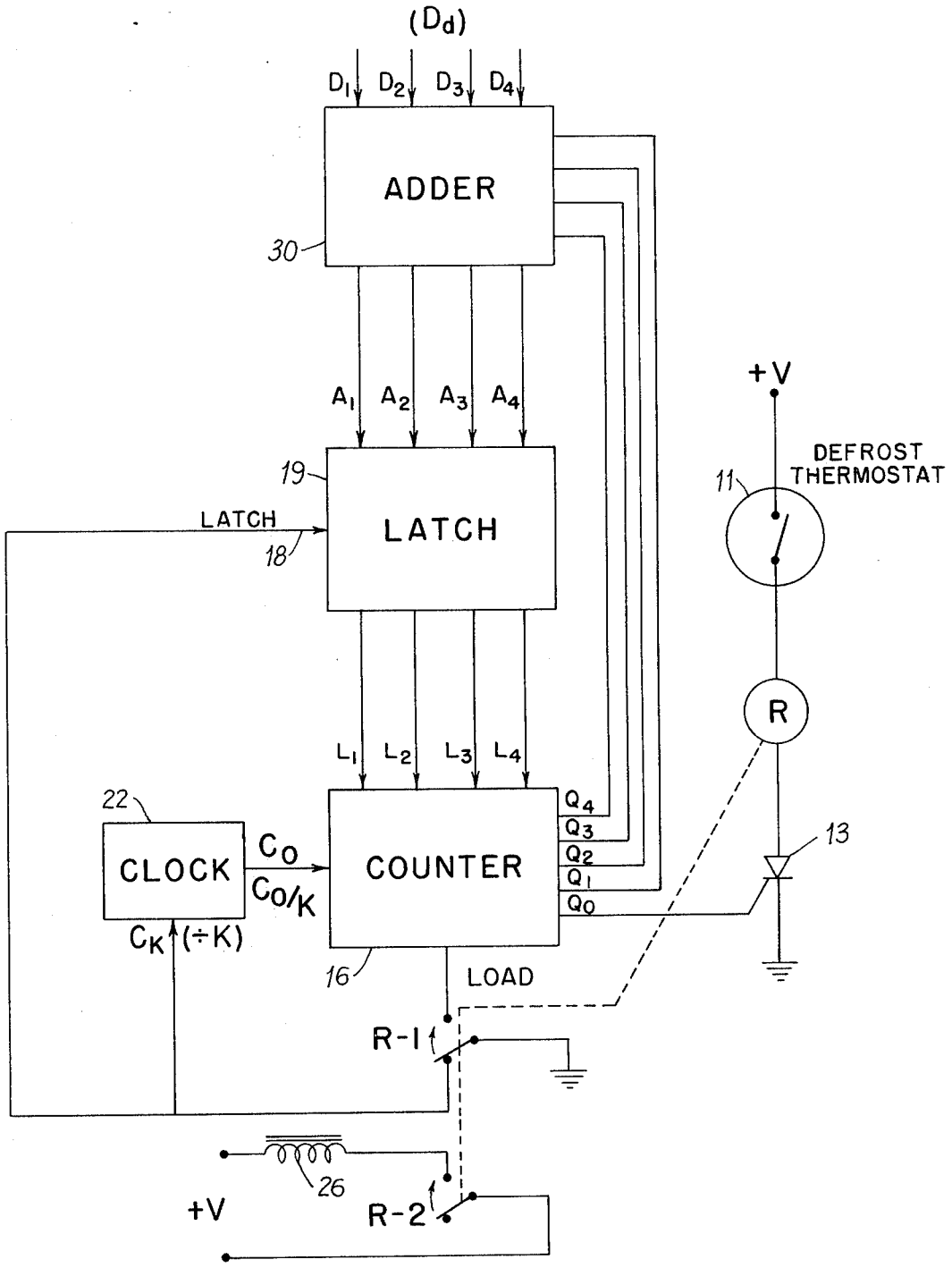
FIG. 1 is a block diagram used in explaining the operating principles of the present invention.

In FIG. 1, a conventional defrost thermostat 11 is connected between a source of voltage V and one terminal of a relay coil R. Thermostat 11 operates to close its contacts when the temperature in the vicinity of a refrigeration evaporator coil is below a predetermined defrosting temperature and to open its contacts when that temperature is exceeded. The other side of relay coil R is connected to the anode of a semiconductor switching device such as silicon controlled rectifier (SCR) 13. The cathode of SCR 13 is connected to ground. The gate electrode of SCR 13 is coupled to the $Q_o$ output terminal of a settable count-down counter 16.

Relay R controls the movable contacts of relay switches R-1 and R-2. In the position illustrated in FIG. 1, relay switch R-1 completes a connection to ground from the latch terminal 18 of a quad latch device 19, and from the $C_k$ (divide by K) terminal of clock source 22. Normally open relay switch R-2 is in series with a voltage source and with the solenoid coil 26 of a reversing valve of a heat pump, for example. Solenoid coil 26 is unenergized when relay coil R is unenergized. As another example, solenoid coil 26 could control a contactor that controls a defrost heater and a refrigerator compressor.

When relay coil R is energized, relay switch R-1 connects the LOAD input of counter 16 to ground. This connection causes the count on input terminals L1–L4 to be loaded into corresponding stages of the counter, thereby to preset the counter to whatever coded count is represented by the energization states of input leads L1–L4. The clock input $C_o$, or $C_o/K$, that is coupled to counter 16 causes the counter to count down toward zero from its preset count, as will be explained.

The coded number on input lines L1–L4 is the number stored in latch device 19. The number in latch device 19 is the number that appears on output lines A1–A4 of the adder 30 when the latch signal occurs on input 18 of the latch device.

Adder 30 adds two coded numbers that appear on its respective input lines D1–D4 and Q1–Q4, the latter being the coded output of counter 16.

When counter 16 counts down to zero a high signal on its output line $Q_o$ is coupled to the gate of SCR 13. If the contacts of defrost thermostat 11 are closed when a high signal on $Q_o$ occurs, relay R is energized to transfer relay contact R-2 to its closed position, thereby energizing solenoid coil 26 and reversing the direction of the reversing valve in the heat pump. At this same time, relay switch R-1 transfers to connect the LOAD terminal of counter 16 to ground. This causes the coded number from input lines L1–L4 to be loaded into the counter.

Clock source 22 produces two series of output pulses at different frequencies. One output is at a fast frequency $C_o$ at which clock pulses occur at a rate of one pulse each 20 seconds, for example. The other output is at a slower frequency $C_o/K$, where $K=64$ in this example, or a rate of one pulse every 21.3 minutes. During a frost accumulating period when relay switch R-1 is in the position illustrated to connect clock terminal $C_k$ to ground, clock pulses at the slower rate of one pulse each 21.3 minutes are coupled to counter 16. During a defrosting period when relay switch R-1 opens the ground line to the $C_k$ terminal of clock 22, the clock pulses coupled to counter 16 are at the faster rate of one pulse each 20 seconds.

The above stated clock pulse rates mean that during a defrost period a count down of one pulse in counter 16 represents 20 seconds, and during a frost accumulating period a count down of one pulse represents 21.3 minutes.

The operation of the system illustrated in FIG. 1 will be explained by first assuming that a defrost operation is just beginning. It also will be assumed that the desired optimal defrost time period Dd is 140 seconds. Therefore, input lines D1–D4 to adder 30 are appropriately energized to couple a coded number representing 140 to adder 30. Since one clock pulse during a defrost period represents 20 seconds, the coded number on lines D1–D4 will be $7(20\times7=140$ seconds).

The contacts of defrost thermostat 11 will be closed, and for reasons that will be explained subsequently, the $Q_o$ output of the counter 16 will be high. SCR 13 therefore conducts and relay R is energized. Relay switch R-2 closes and causes solenoid winding 26 to be energized. This reverses the reversing valve in the heat pump system and causes warm fluid to pass through the evaporator coil. At this same time, relay switch R-1 closes on its upper contact to connect the LOAD terminal of counter 16 to ground. This causes the coded number on input lines L1–L4 to be loaded into, or to preset, counter 16. For this discussion it will be assumed that the coded number on lines L1–L4 now is 13. It will be explained below how the coded numbers that are stored in the four stage latch device 19 and coupled into counter 16 are derived.

When relay switch R-1 opens the line between ground and the Ck terminal of clock 22, the clock output changes to the faster rate $C_o$ at which pulses occur every 20 seconds. These pulses are coupled to the clock input of counter 16 and cause the counter to count down one count for each pulse, i.e., one count each 20 seconds.

It was assumed above that the count preset into counter 16 was the count of 13. It also will be assumed at this stage of the discussion that the length of the actual defrost period Da in this particular cycle is 120 seconds. This actual defrost time Da is shorter than the desired defrost period Dd of 140 seconds, which means that not enough frost was allowed to accumulate on the evaporator coil. The 120 seconds actual defrost time Da means that six clock pulses at the rate $C_o$ are coupled to counter 16 before the contacts of defrost thermostat 11 open. Consequently, the count remaining in counter 16 and the coded count appearing on counter output lines Q1–Q4 is equal to seven, i.e., $13-6=7$. This count on lines Q1–Q4 is coupled to adder 30 and is added to the count of 7 on input lines D1–D7 that represents the desired defrost period Dd. The count on output lines A1–A4 now is 14.

When the contacts of defrost thermostate 11 opened, as just described, relay switch R-1 transferred to its lower stationary contact and provided a connection from ground to the Ck input of clock 22, and to the latch input of the four stage latch device 19. Clock 22 now transfers to its $C_o/K$ rate and couples a pulse to counter 16 every 21.3 minutes. Additionally, the number 14 that now is on the output line A1–A4 of adder 30 is latched into the four parallel stages of latch device 19. This number 14 is coupled to the inputs of counter 16, but that number is not loaded into the counter because its LOAD terminal is open.

Counter 16 counts down one count each occurrence of a clock pulse at the $C_o/K$ rate and reaches zero count in 149.1 minutes ($21.3\times7=149.1$). During this time, frost is building up on the evaporator coil.

When counter 16 reaches a zero count its $Q_o$ output goes high and SCR 13 is rendered conductive since the contacts of defrost thermostat 11 will be closed. Relay R again is energized to transfer relay switches R-1 and R-2 to the positions opposite to those shown in FIG. 1. As a result, switch R-2 again energizes solenoid 26 to initiate a defrosting of the evaporator coil. The LOAD terminal of counter 16 is connected to ground to cause the number 14 on input lines L1–L4 to be loaded into the counter. Clock pulses $C_o$ at the rate of one pulse each 20 seconds are coupled into counter 16 to cause it to count down toward zero. It is seen that a high signal on line $Z_o$ comprises a defrost signal that initiates a defrost operation.

This second defrost period of this example will be assumed to last for 140 seconds before the coil is defrosted and thermostat 11 opens its contacts to deenergize relay R. During this time, counter 16 counted 7 clock pulses ($140\div20=7$) and the count of $7(14-7=7)$ remains in counter 16. This count is coupled over lines Q1–Q4 to adder 30 and is added to the desired defrost time Dd, which is a count of 7. The count on lines A1–A4 now is 14.

Relay R is deenergized when frost is cleared from the heat transfer unit and solenoid 26 is deenergized by relay switch R-2. The defrost operation therefore is terminated. Switch R-1 closes on its lower stationary contact to transfer clock 22 to its $C_o/K$ output rate, and to latch the count of 14 on lines A1–A4 into latch device 19. Counter 16 now counts down one count each clock pulse occurring each 21.3 minutes, or a total frost accumulating time of $21.3\times7=149.1$ minutes.

It is seen that at this point the defrost cycle has stabilized since the actual defrost time Da (140 seconds=7 counts) is equal to the desired defrost time Dd (140 seconds=7 counts), and that the frost accumulating period Ta remains the same as the previous one $T_{(a-1)}$ at 149.1 minutes. Therefore, the above equation reduces to the following.

$$Ta=T_{(a-1)}+K(Dd-Da)$$

$$149.1=149.1+64(140-140)$$

$$149.1=149.1$$

If additional frost should begin to accumulate on the evaporator coil because the ambient humidity increases, for example, the next actual defrost period will be longer in time before the contacts of thermostat 11 open. For each additional count of defrost time (20 seconds), the subsequent frost accumulating period will be shortened by one count, or (K×20 secs.)=(64×20)=1280 secs.=21.3 minutes. This shortened frost accumulation period means that less frost will have accumulated so that the required actual defrost time will be reduced in length. This operation continues until the defrost cycle stabilizes at the desired defrost time.

The same type of compensating operation automatically follows in the event that less than the predetermined critical amount of frost accumulates on the evaporator coil. For example, if the coil defrosts in 100 seconds (5 counts) instead of 140 (7 counts), counter 16 will have to count down 9 counts (14−5=9) instead of 7 during the frost accumulating time $T_{(a-1)}$. This means that the frost accumulating period increases by a count of 2, or 2×21.3=42.6 minutes, to a total frost accumulating time of 191.7 (149.1+42.6) minutes. More frost will accumulate on the coil in this lengthened period and it will take a longer time to clear the frost the next defrost period.

Figure 2:
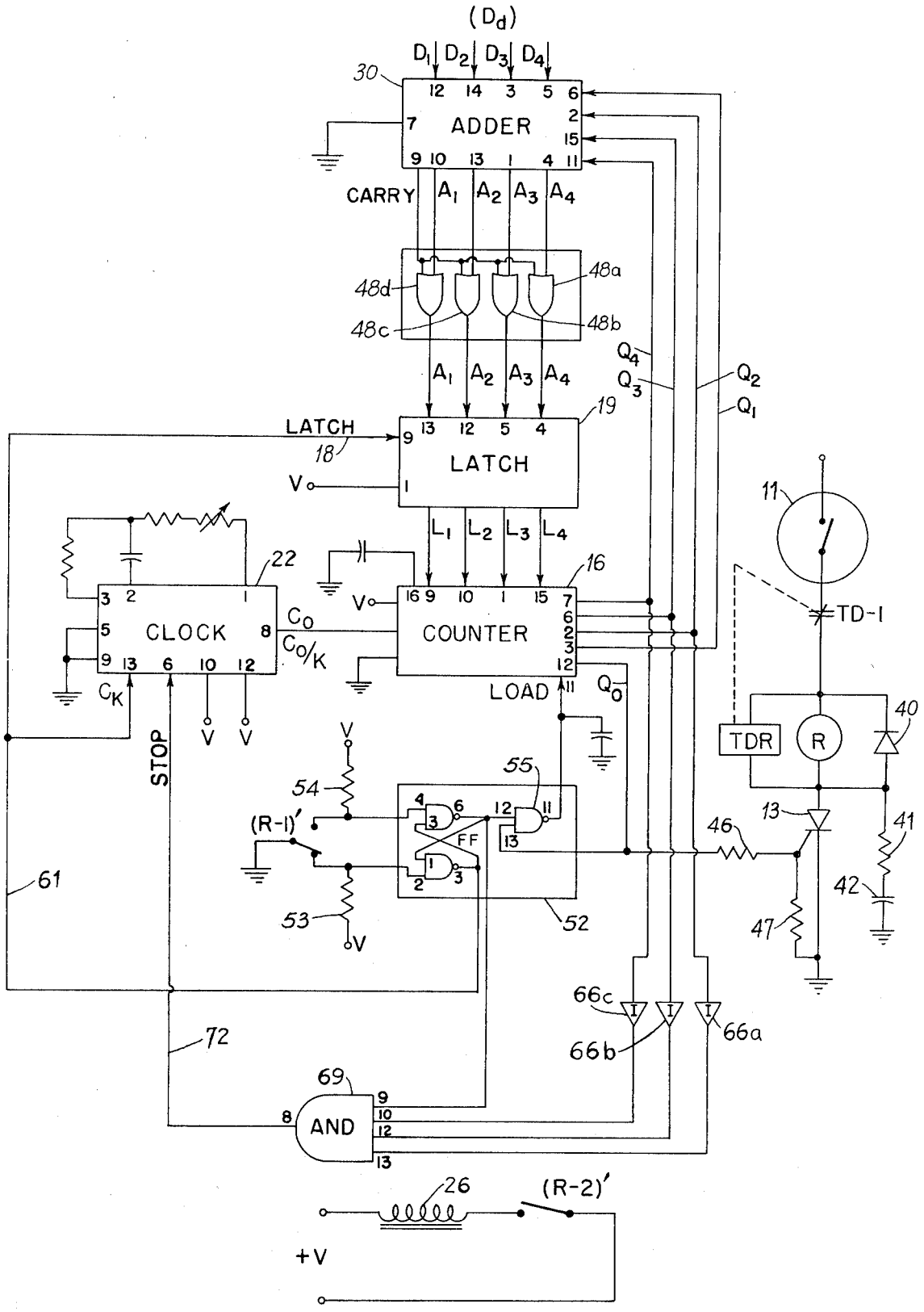
FIG. 2 is a wiring diagram partly in block form and partly in schematic form illustrating an operative embodiment of the invention.

FIG. 2 is a more detailed illustration of a practical circuit constructed in accordance with the present invention. The system employs a number of commercially available integrated circuit chips that are represented in their package form with connections made to the terminal or pin numbers designated by the respective manufacturer. Where applicable, the same reference numerals are used in FIG. 2 to designate the same functional items as in FIG. 1.

Relay R is shunted by a diode 40 to pass reverse current produced by back e.m.f. on the coil of the relay. A dv/dt protection circuit comprised of resistor 41 and capacitor 42 shunt SCR 13, as is conventional. Resistors 46 and 47 constitute a voltage divider for providing a desired signal level on the gate of SCR 13.

A time delay relay TDR is connected in parallel with relay R and has a set of normally closed contacts TD-1 in series with the two relays and with defrost thermostat 11. Time delay relay TDR is activated when relay R is energized and begins timing a delay period that is several clock pulse periods (at frequency $C_o$) longer than the longest defrost time period anticipated. If for some reason the contacts of defrost thermostat 11 should stick in the closed position, the system might get "hung up" in the defrost period were it not for the time delay relay which causes its contacts TD-1 to open at the conclusion of its delay period. The time delay relay is reset to zero each time power is interrupted to its power terminals. Thus, it is reset at the conclusion of each defrost period and every time it "times out" to open its contacts. A suitable time delay relay is obtainable from Potter & Brumfield Division of AMF incorporated, Princeton, Ind., under the designation CGD-38-30005AA. Other relays of the CG series also are suitable for specific applications.

The output terminals A1–A4 of the adder 30 are coupled through respective OR gates 48*a*–48*d* to the input terminals of latch device 19. Output pin 9 of adder 30 is the carry output. This terminal is coupled to an input of each OR gate 48*a*–48*d* to assure that all ones are coupled to the inputs of latch device 19 when the sum in adder 30 is large enough to generate a carry signal. This assures that the maximum four bit number will be stored in the latch, and subsequently loaded into counter 16, when the four bit capacity of adder 30 is exceeded.

The relay switch R-1 of FIG. 1 corresponds to the relay switch (R-1)′ and the flip flop (FF) portion of the solid state circuit 52 in FIG. 2. Circuit 52 comprises three NAND gates of a four NAND gate chip. Input terminals 2 and 4 of circuit 52 are coupled through respective resistors 53 and 54 to the voltage supply V, and to a respective stationary contact of relay switch (R-1)′. The movable contact of relay switch (R-1)′ is closed on the lower stationary contact, as illustrated, when the system is in the frost accumulating period.

When the movable arm of relay (R-1)′ is closed on the lower stationary contact, as illustrated, the output at pin 6 of the flip flop is low. When the relay is closed on its upper stationary contact the output at pin 6 of the flip flop is high.

Output pin 11 of NAND gate 55 in semiconductor circuit 52 is connected to the LOAD input, pin 11, of counter 16. A low signal on the LOAD input causes the coded number on input lines L1–L4 to be loaded into counter 16 to preset the counter to that number.

The $Q_o$ output on pin 12 of counter 16 is high (defrost signal) only when the count in the counter is zero. This $Q_o$ lead is coupled to the gate electrode of SCR 13 and to input pin 13 of NAND gate 55.

Clock 22 produces clock pulses at the higher frequency $C_o$ (one pulse every 20 seconds) when the signal at its Ck input on pin 13 is low. The clock frequency changes to the slower frequency $C_o/K$ (one pulse every 21.3 minutes) when the signal on the Ck input switches to its high level. The Ck input of clock 22 is coupled over lead 61 to pin 3 of the flip flop in circuit 52. Pin 3 is low when relay switch (R-1)′ is closed on its upper contact, i.e., during defrost, and changes to a high when the relay switch closes on its lower contact, i.e., when the frost accumulation period begins.

The three most significant bits Q2, Q3, Q4 of the output of counter 16 are coupled through respective inverters 66*a*, 66*b*, 66*c* to respective input terminals of AND gate 69. The other input on pin 9 of AND gate 69 is the signal on pin 6 of the flip flop in circuit 52. The purpose of AND gate 69 is to detect when counter 16 has counted down to a count of one during a defrost period. When a count of one is reached in the counter, the three most significant bit signals on output lines Q2, Q3, Q4 all will be zeros. These signals will be converted to ones by inverters 66*a, b, c*. Pin 6 of the flip flop in circuit 55 will be high only when relay switch (R-1)′ is closed on its upper contact, i.e., when the system is in the defrost period. Therefore, when the system still is in defrost, and just before the counter reaches zero, all inputs to AND gate 69 are high and a high signal is coupled over lead 72 to input pin 6 of clock 22. This high signal stops all clock pulse outputs on pin 8 of clock 22 so that no further pulses are coupled into counter 16. Consequently, counter 16 stops counting down and holds the one count. The system waits in this condition until the defrost thermostat 11 opens to terminate the defrost period.

Had counter 16 been allowed to count down to zero before the evaporator coil actually defrosted, the $Q_o$ output of the counter would have gone high. This defrost signal would again trigger the gate of SCR 13 (which is conducting at this time) and would put a high signal on pin 13 of NAND gate 55. Pin 12 also would be high so that the output on pin 11 would go low to cause the coded number on leads L1–L4 to be loaded into counter 16. This, then, commences a new defrost period with a count in counter 16 that probably has no relationship to the intended system concept. By prohibiting the counter from counting to zero the system waits until defrost thermostat 11 opens and deenergizes relay R to begin a defrost accumulation period. In this case, the frost accumulation period will last one count, or 21.3 minutes, before another defrost period begins.

It will be noted that AND gate 69 will not pass a high signal when the system is in the frost accumulation period because relay switch (R-1)' will be closed on its bottom contact and pin 6 of the flip flop will be low. This low signal will serve as an inhibit signal at input pin 9 of AND gate 69. Consequently, counter 16 can count past a one count when the system is in the frost accumulating period.

The description of the operation of the system of FIG. 2 will begin with the beginning of the defrost operation, using the same numerical examples as in the description of FIG. 1. As before, the coded number Dd on input lines D1–D4 of adder 30 represents the desired defrost time and is assumed to be the numeral 7, or 140 seconds. It also again will be assumed that the number stored in latch device 19 is 13. The contacts of defrost thermostat 11 are closed, and when counter 16 reaches zero count, its output line $Q_o$ goes high, thereby providing a defrost signal. This signal is coupled to the gate of SCR 13 and causes it to conduct, thereby energizing relay R. Relay switch (R-2)' closes and energizes solenoid 26 which transfers a reversing valve in a heat pump system to cause warm fluid to flow through the evaporator coil. In a conventional refrigeration system, the closing of switch (R-2)' would energize a defrost heater and deenergize a compressor motor.

Activation of relay R also transfers switch (R-1)' to its upper contact which causes pin 4 of the flip flop in circuit 52 to go low. Pin 6 of the flip flop goes high so that both inputs 12 and 13 of NAND gate 55 are high. Consequently, the output at pin 11 goes low and couples a low signal to the LOAD terminal of counter 16. The number 13 on lines L1–L4 is loaded into and presets counter 16.

Because the content of the counter 16 no longer is zero, the signal on line $Z_o$ now goes low. This low signal appears at input pin 13 of NAND gate 55. The signal at input pin 12 still is high so that the output on pin 11 of NAND gate 55 goes high. This terminates the LOAD terminal to counter 16.

SCR 13 will continue to conduct since its anode remains high.

At this same time, pin 3 of the flip flop goes low. This signal is coupled over lead 61 and causes the output of clock 22 to transfer to its faster rate $C_o$ at which clock pulses occur every 20 seconds. Latch 19 is not affected by the low signal on lead 61.

Counter 16 commences to count down from the preset count of 13 at the rate of one count each 20 seconds. In keeping with the previous example, the assumed actual defrost time for this cycle was 120 seconds, so counter 16 counts down 6 counts before the contacts of thermostat 11 open to deenergize relay R. The count remaining in counter 16 is seven, and this coded number is coupled over leads Q1–Q4 to adder 30 where it is added to the coded number Dd, which also is seven. The coded number on output lines A1–A4 of adder 30 and on the inputs of latch device 19 therefore is 14.

The deenergization of relay R causes relay switch (R-2)' to open its contacts and deenergize solenoid 26. This allows the reversing valve of the heat pump system to return and allows normal flow of fluid through the evaporator coil.

Relay switch (R-1)' transfers to the lower stationary contact at the conclusion of the defrost operation so that input pin 2 of the flip flop goes low and input pin 4 goes high. Pin 3 of the flip flop goes high. This high signal is coupled over lead 61 to input Ck of clock 22 and to the latch input 18 of latch device 19. The frequency of clock 22 transfers to its slow rate of $C_o/K$, at which pulses occur once each 21.3 minutes. The LATCH signal on lead 18 causes the coded number on inputs A1–A4, the number 14, to be loaded into latch device 19. This causes the number 14 to appear on lines L1–L4, but it will not be loaded into counter 16 until another LOAD command is coupled to its pin 11.

Counter 16 counts down at the rate of one count each 21.3 minutes, and since the count in the counter at the beginning of the frost accumulating period was 7, the count of zero will be reached after 149.1 minutes. It will be noted that pin 6 of the flip flop in circuit 52 is low during this frost accumulating period so that AND gate 69 is disabled by the low signal on its input pin 9. Therefore, line 72 is low and no STOP signal is coupled to pin 6 of clock 22. As a consequence, counter 16 can count down past one to reach a zero count which energizes its $Q_o$ output to produce the defrost signal.

When the zero count is reached, SCR 13 again is triggered and relay R is energized since the contacts of defrost thermostat 11 are closed at this time. Relay switches (R-1)' and (R-2)' are transferred to their positions opposite to those shown in FIG. 2. Pin 12 of NAND gate 55 goes high, and pin 13 already is high, so that a low signal on pin 11 causes a LOAD command to be coupled to pin 11 of counter 16. The coded number 14 on leads L1–L4 therefore is loaded into the counter.

Pin 3 of the flip flop in circuit 52 goes low and that signal is coupled over lead 61 to the Ck input of clock 22 to cause it to transfer to its higher output frequency $C_o$. Clock pulses occurring every 20 seconds are coupled to counter 16 to cause the counter to count down from 14. The counting continues at this rate until the evaporator coil is defrosted and defrost thermostat 11 opens its contacts to terminate the defrost operation.

The system will continue to operate as described, always striving to allow only a predetermined amount of frost to build up on the coil and always working toward defrosting the predetermined amount of frost in the desired defrost time Dd. If the actual defrost time Da is longer than Dd, the next frost accumulating period Ta will be shorter because the count remaining in counter 16 will be smaller. On the other hand, if the actual defrost time Da is shorter than Dd, the next frost accumulating period Ta will be longer because the count remaining in counter 16 will be larger.

The system illustrated in FIG. 2 is but one example of means for carrying out the concept of the present invention. Other systems having different operating details may be employed as well. For example, in place of count down counter 16 a count up counter may be employed to count up to a predetermined count to produce a defrost command signal. In such an alternative system, additional signal processing may be required, but the end result will be the same.

Listed below are representative integrated circuit packages that may be employed in the circuit of FIG. 2.

Counter 16: SN74191
Latch 19: SN74175
Clock 22: MC14541CP
OR gates 48*a–d*: SN7432
Adder 30: SN74283
NAND Circuits 52: SN74LS00N
Inverters 66*a–c*: 74LS04

AND gate 69: 74LS21

What is claimed is:

1. A method for controlling the defrosting of a heat transfer unit of a temperature conditioning system by initiating a defrost operation when a predetermined amount of frost has accumulated on the unit during a frost accumulating period that occurs between defrost operations, a known desired defrost time period being required to defrost said unit when it has the predetermined amount of accumulated frost thereon, said method comprising the steps determining the time required to actually defrost said unit during an actual defrost operation, increasing the frost accumulating period before initiating the next defrost operation if the time to complete the last defrost was less than said desired defrost time period, or decreasing the frost accumulating period before initiating the next defrost operation if the time to complete the last defrost was greater than said desired defrost time period.

2. A method for controlling the defrosting of a heat transfer unit of a temperature conditioning system by initiating a defrost operation when a predetermined amount of frost has accumulated on the unit during a frost accumulating period that occurs between defrost operations, comprising the steps establishing a desired defrost time that is required for defrosting said predetermined amount of accumulated frost from the unit, determining the time required to actually defrost said unit during an actual defrost operation, increasing the frost accumulating period before initiating the next defrost operation if the time to complete the last defrost was less than said desired defrost time, or decreasing the frost accumulating period before initiating the next defrost operation if the time to complete the last defrost was greater than said desired defrost time.

3. A method for controlling the defrosting of a heat transfer unit of a temperature conditioning system by initiating a defrost operation when a predetermined amount of frost has accumulated on the unit during a frost accumulating period that occurs between defrost operations, a known desired defrost time period being required to defrost said unit when it has the predetermined amount of accumulated frost thereon, said method comprising the steps, loading a counter with a coded number, counting in the counter clock pulses occurring at a first rate during a defrost time period and counting clock pulses occurring at a slower rate during a frost accumulating period, said two clock rates being related by the factor k, determining when the unit is defrosted, adding the count in the counter at the end of a defrost time period to a number representing the desired defrost time period to obtain a sum, producing a defrost signal from the counter when a predetermined count is arrived at in the counter during the frost accumulating period, loading said sum into the counter in response to a defrost signal and commencing to count the clock pulses received during the subsequent defrost time period and frost accumulating period until said predetermined count again is reached in the counter.

4. The method claimed in claim 3 wherein the counting in said counter is from a preset number toward zero count, and wherein said predetermined count is zero.

5. The method claimed in claim 4 including the step preventing the counter from counting to zero when the system is in the defrost time period.

6. The method claimed in claim 4 and further including the step terminating a defrost time period and initiating a frost accumulating period a given time after the defrost time period begins if it is not otherwise terminated.

7. Apparatus for controlling the defrosting of a heat transfer unit of a temperature control system by initiating a defrost operation when a predetermined amount of frost has accumulated on the unit during the frost accumulating period that occurs between defrost operations, a known desired defrost time period being required to defrost said unit when it has the predetermined amount of frost thereon, said apparatus comprising means for determining the time required to actually defrost said unit during an actual defrost operation, means for increasing the next frost accumulating period if the time to complete the last defrost was less than said desired defrost time period or decreasing the next defrost accumulating period if the time to complete the last defrost was greater than said desired defrost time period.

8. In a system for controlling the application of heat to a heat transfer unit of a temperature conditioning system to defrost the unit when a predetermined amount of frost was accumulated on the unit, a known desired defrost time being required to defrost said unit when it has said predetermined amount of frost thereon, the combination comprising a pulse counter, said counter being capable of being preset and operating in response to clock pulses to count to a given number at which it produces a defrost signal, clock means for selectively producing clock pulses at a first rate or at a slower second rate, said rates being related by the factor k, means for determining when said unit is defrosted, means operable when it is determined that the unit is defrosted for coupling clock pulses at said second rate to said counter, said counter responding by counting toward said given number and producing a defrost signal when the count reaches the given number, means responsive to said defrost signal for loading the counter with a coded number, means responsive to said defrost signal for coupling clock pulses at said first rate to said counter, means operable when it is determined that the unit is defrosted for adding the count remaining in the counter to a number representing the desired defrost time period and producing said coded number as the sum.

9. The system claimed in claim 8 wherein said counter is preset to a count greater than zero by said coded number and counts down toward zero count in response to clock pulses, said counter producing said defrost signal when the count reaches zero.

10. The system claimed in claim 8 and including means for preventing said counter from reaching the count of said given number when the system is in the defrost operation.

11. The system claimed in claim 8 and including means responsive to said defrost signal for applying heat to said heat transfer unit, said last named means being responsive to said means that is operable when it is determined that the unit is defrosted and operable to terminate the application of heat to said heat transfer unit.

12. In a control system for automatically defrosting the heat transfer unit of a temperature control system, the combination comprising heating means for applying heat to the heat transfer unit of a temperature control system for melting accumulated frost on the unit, controllable activating means for activating said heating means upon occurrence of a defrost signal, means providing a first coded signal representing the desired activated time of the heating means for melting a predetermined amount of frost on the heat transfer unit, adder means for adding said first coded signal to a second coded signal to produce a third coded signal, counter means for accepting a coded signal and for counting down toward zero in response to received clock pulses, means responsive to said defrost signal for loading said third signal into said counter means upon occurrence of said defrost signal, means operable upon occurrence of said defrost signal for coupling clock pulses occurring at a first rate to said counter means to cause the counter to count down one count in response to each received clock pulse, defrost thermostat means for determining when the cooling unit is defrosted and for controlling said activating means for deactivating the heating means when the unit is defrosted and for coupling clock pulses occurring at a second rate to said counter means, said second clock pulse rate being slower than the first rate by a predetermined factor K, the count remaining in said counter when the cooling unit is defrosted constituting said second coded signal, means for coupling said second coded signal to said adder means, whereby the adder means adds the first and second coded signals to produce the third coded signal, said counter means counting down to a predetermined number in response to said clock pulses at the second rate, said counter means producing said defrost signal when the count in the counter reaches the predetermined number.

* * * * *